US005441255A

United States Patent [19]

Verbick

[11] Patent Number: 5,441,255

[45] Date of Patent: Aug. 15, 1995

[54] PRACTICE DEVICE FOR BOWLING AND OTHER SPORTS

[76] Inventor: Basil G. Verbick, 3011 Tiffany Ct., Carmel, Ind. 46032

[21] Appl. No.: 75,825

[22] Filed: Jun. 11, 1993

[51] Int. Cl.[6] ..... A63B 69/40

[52] U.S. Cl. ..... 273/26 R; 482/130; 473/55

[58] Field of Search ..... 273/63 R, 191 B, 191 R, 273/26 R, 67 DA, 67 DB, 75, 81 R, 81.4, 81.5, 91.6; 482/101, 130; 434/429; 473/55, 56, 59, 60, 61; 601/24

[56] References Cited

U.S. PATENT DOCUMENTS

| | | | |
|---|---|---|---|
| 1,567,530 | 12/1925 | Macnaughton et al. | 273/191 A |
| 1,997,364 | 4/1935 | Holden et al. | 273/81.4 |
| 4,149,713 | 4/1979 | McLeod | 482/101 |
| 4,640,268 | 2/1987 | Roberts | 601/24 |
| 4,743,014 | 5/1988 | Loane | 482/130 |
| 4,842,270 | 6/1989 | Lange | 482/101 |
| 5,151,070 | 9/1992 | Norman | 273/191 B |
| 5,197,933 | 3/1993 | Waters | 273/191 R |

FOREIGN PATENT DOCUMENTS

| | | | |
|---|---|---|---|
| 8341 | of 1914 | United Kingdom | 273/191 A |
| 174140 | 1/1922 | United Kingdom | 273/191 A |

*Primary Examiner*—Theatrice Brown

*Attorney, Agent, or Firm*—Hopkins & Thomas; James W. Kayden

[57] ABSTRACT

A practice device for bowling and other sports or activities that utilize an underhand throwing motion is disclosed, the device including a base, an arcuate track mounted on the base, and a carrier which engages the track. The user moves the carrier along the track, thereby practicing the idealized underhand swing motion.

3 Claims, 3 Drawing Sheets

PRACTICE DEVICE FOR BOWLING AND OTHER SPORTS

BACKGROUND OF THE INVENTION

Bowling and certain other sports, for example, softball pitching, horseshoes, lawn bowling, bocce ball, curling, and others require the participation to use an underhand throwing motion.

In addition to this throwing motion, for a right-handed participant, several other motions or positions are common for proper and consistent form. The left foot is pointed at the target at delivery; the left knee is bent; there is a forward bend at the waist; the right leg is extended for balance as is the left arm; and the arm swings through delivery like a pendulum. Also, at the same time, the right arm bends at the elbow in the follow-through; the right wrist, hand, thumb, and fingers all break upwardly in sequence; and the head, eyes, and shoulders are square, i.e. facing the target. As is the case with most sports or games, the more one practices, the better one becomes. Extensive practice can change amateur players into professionals. However, practice requires effort, time, a practice facility, and can be quite expensive.

Practice devices for many different sports are known in the prior art. U.S. Pat. Nos. 3,341,208 and 4,071,251 teach golf swing training aids. U.S. Pat. No. 4,220,333 to Mercer shows a bowling practice device in which a conventional bowling ball is retained within a cage-like retainer structure secured to the participant's wrist. As the bowler practices, the ball is released into the retainer, obviating the need for the bowler to practice at a bowling facility.

With particular regard to the sport of bowling, success depends to a large part on the proper release of the ball at the foul line. Most current professional bowlers release the ball and finish the stroke in the same basic manner. As the ball is released, the thumb comes out of the ball first, allowing the fingers and wrist to guide the rotation of the ball. As the arm continues into the follow-through, the thumb ends up pointing toward the eyes of the bowler. In addition, the head remains straight, eye contact is focused on a spot over which the ball is released, the shoulders are square to the target, the knees are bent, and the lead foot is pointed straight toward the head pin. These mechanics can be practiced virtually anywhere but currently are best practiced at bowling lanes. Unfortunately, time constraints, lane availability, costs, and other factors combine to limit practice time and consequently, improvement.

SUMMARY OF THE INVENTION

It is, therefore, one of the principal objects of the present invention to provide a practice device for bowling and other sports utilizing an underhand throwing motion that is designed for use in the home or at a gymnasium or workout facility as well as at the bowling lanes.

Another object of the present invention is to provide a practice device which forces the user to exercise and practice in an optimum manner, keeping the arm moving in an ideal arc or swing such that the user will gain and maintain good habits.

A further object of the present invention is to provide a practice device that is adjustable for participants of different heights and which is designed for use with interchangeable handles or balls used in different sports.

A still further object of the present invention is to provide a practice and exercise device that is easy to use and transport if necessary, and which is durable to provide a long service life.

These and other objects and advantages are attained by the present invention which relates to a practice device for bowling and other activities having a base, a track member mounted on the base, and a handle means disposed in or on the track. The handle means is designed to follow the track, forcing the user to swing the arm in an ideal arc, thereby promoting proper swing mechanics.

The handle may be provided in a plurality of configurations, such as a bowling ball, softball, horseshoe, and like objects, and is also provided as a straight rod member with positioning means for the user's thumb. The present device may be designed and built specifically for a fight or left handled person, or may be universal for use with either hand.

Various additional objects and advantages of the present invention will become apparent from the following detailed description, with reference to the accompanying drawings.

DETAILED DESCRIPTION OF THE PREFERRED EMBODIMENT

Figure 1:
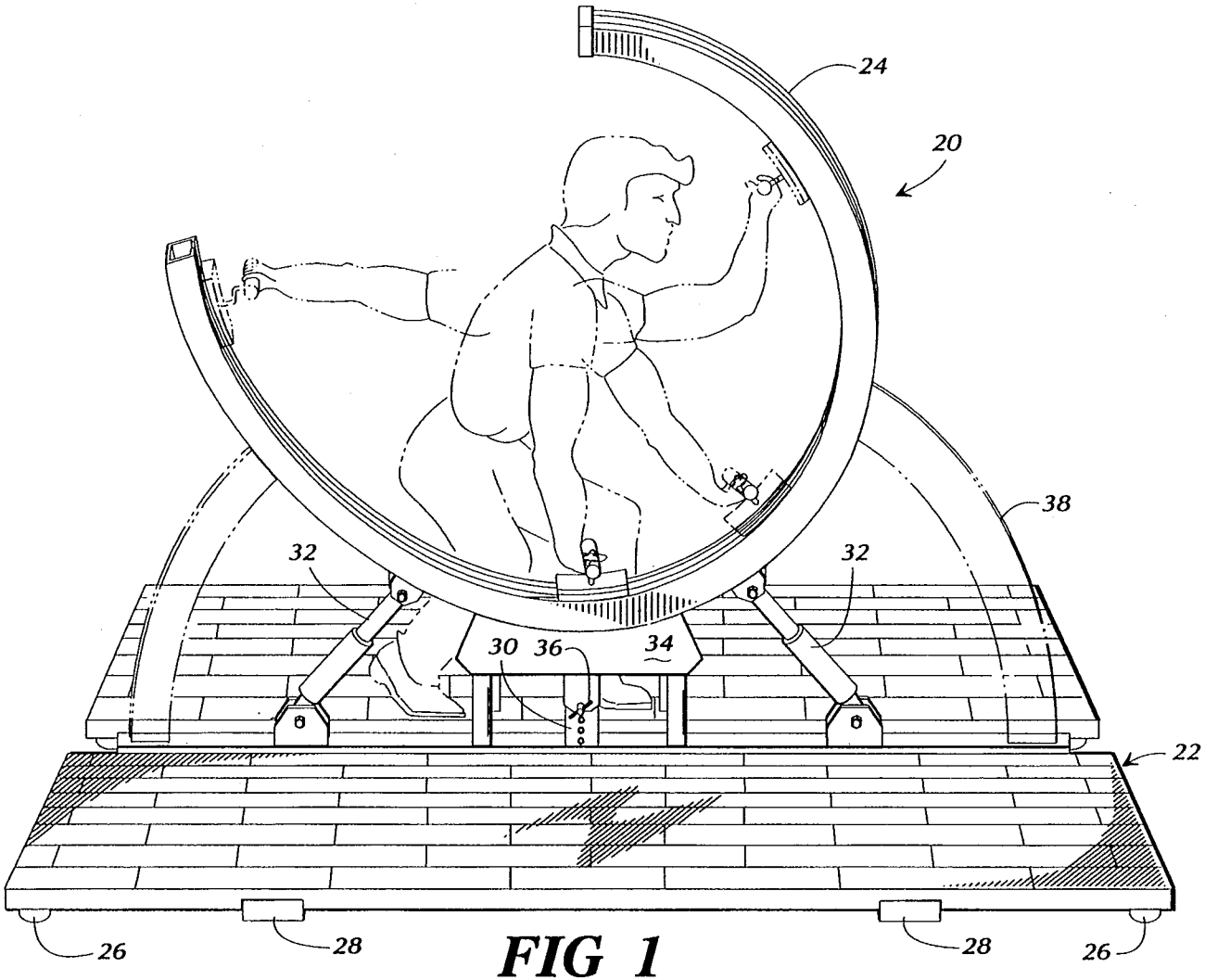
FIG. 1 is a side elevational view of the present practice device, the arm motion of the user being shown in phantom lines.

Referring now more specifically to the drawings and FIG. 1 in particular, numeral 20 designates the present practice device for bowling and other sports, shown in FIG. 1 set up for bowling practice. The device includes an elongated base 22, which is shown as being made of wood and is polished so as to permit the user to move or slide one foot in performing underhand throwing motions. Other materials and surfaces for the base may also be used, i.e., plastic, metal, etc.; smooth finish, textured, rough, etc. The base is elongated sufficiently to accommodate a one or two-step delivery of the ball, horseshoe, or other handpiece, such as will be described later, and extends at least through the lengthwise extent of the track 24, as viewed in FIG. 1. The base may also include feet 26 and a brace or braces 28, for lateral stability. While shown in FIG. 1 with the base extending on both sides of the track 24, to accommodate fight and left handed users, the base may also comprise a single panel, which can be transferred from one side to the other.

The track 24 is semi-circular or arcuate in shape and is designed to allow the user to move the delivery arm and hand through an ideal or idealized motion for bowling, softball pitching, horseshoes, and other sports. In bowling, for example, the arm is fully extended on the back swing and bends toward the bowler's head on the follow-through, as shown by the phantom lines in FIG. 1. Thus, the track has a relatively flat curve in the rear section, an almost perfect circle at the bottom, and a more pronounced curve at the front or finish section. Similar motions are used for other sports using underhand delivery. In order to develop consistency in a sport such as bowling, the approach to the foul line and the delivery of the ball should be essentially the same each time the ball is delivered. The bowler's arm must always move in the same plane and in a straight forward direction to impart the proper direction and rotation to the ball. With the present device, the user is forced to use the proper motion, without the variables inherent in actual practice bowling or when receiving bowling lessons. The idealized motion gained with the present invention can then be easily transferred to actual practice or competition.

The track is height adjustable to accommodate users of any height and is provided with height-adjustable support means, such as leg assembly 30 and struts 32. The leg assembly has a track-engaging saddle 34 which can be elevated or lowered using a pin and slot means 36, or other stiltable height-adjusting means. For example, a racheting system may be used. Alternatively, struts 32 could be used in either a vertical or the slanted position as shown in FIG. 1, to adjust the height of the track above the base. Auxiliary supports 38 may be added for stability as necessary.

The track itself is formed from a suitable lightweight material such as aluminum or plastic. The track preferably has a C-shaped cross-section with a central slot 40 facing outwardly to receive the carrier on which is mounted the ball, handle, or other means. Alternatively, the track can be a single curved sheet or tube of suitable material, having the same or a similar shape to that shown. In such an embodiment, the carder, as described below, would engage the track instead of tiding therethrough. The surface of the track means which contacts the carder may be coated with a substance such as that sold under the trademark TEFLON® to facilitate movement in or on the track.

Figure 3:
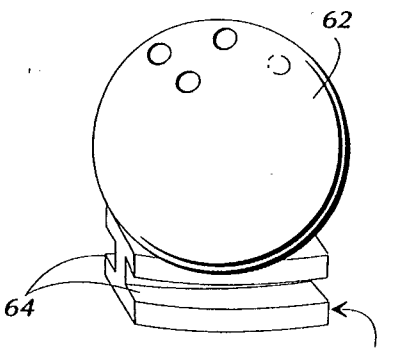
FIG. 3 is a perspective view of one embodiment of a handle for the present device.

The carrier is shown in various embodiments in FIGS. 3 through 8. FIG. 3 illustrates an I-shaped block means 60. Mounted on the block 60 is a replica or simulated bowling ball 62. The ball 62 is configured to be usable by either a right or left handed bowler and can be lighter, heavier, or the same weight as a conventional ball. Grooves 64 engage the facing edges 66 of the track 24, which together define the slot 40. Where the track means comprises a single curved sheet or tubular material, the block 60 would simply be configured with essentially a C-shape, to engage the track and travel through the curve formed thereby.

Figure 4:
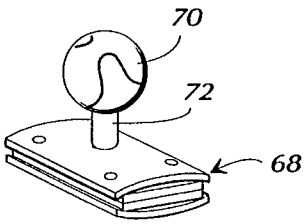
FIG. 4 is a perspective view of an alternate embodiment of a handle.

FIG. 4 illustrates a different type of block means 68. This block has radiused edges to facilitate its traveling through the track means. Mounted on block 68 is a replica of a softball 70, the ball being spaced from the block and connected thereto by a neck 72. The neck travels through the groove 40 as the pitching motion is practiced. Block means 68, fitting inside the track, is of a sufficient width to travel easily within the confines of the track without racking or twisting. While some contact with the inner wall surfaces of the track is possible, it does not impede the motion of the particular carder. As a further aid to movement, the grooves 64 of block 60, the outer surfaces of block 68, and any other parts of the various block means described herein may also be coated with a non-stick material, such as TEFLON® or the like.

The carder embodiments shown in FIGS. 5 through 8 have a bar-shaped handle 74. This handle is disposed at approximately a 35° to 45° angle relative to the direction of travel through the track. This angle approximates a favorable or idealized hand position for delivering a bowling ball such that an overspin is imparted to the ball upon its release in order to help propel the ball through the bowling pins. The handle 74 includes cutouts 76 which are disposed at an approximate 45° angle relative to the longitudinal axis of the handle. The cutouts are also disposed at approximately 90° relative to one another to accommodate right or left handled users. The cutouts are designed to receive the user's thumb and place the thumb and fingers in the preferred position for delivering the bowling ball. This particular embodiment is shown in FIG. 1. As illustrated, the user's hand is disposed slightly to one side of the "ball" and follows a straight ahead path from the backswing to the followthrough. When finished, the bowler's thumb ends up pointing toward the eyes or forehead. As noted, this motion imparts overspin to the ball when bowling, which is desirable whether the bowler is right or left handled.

Figure 6:
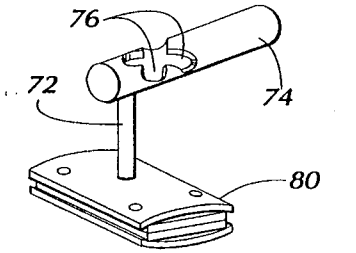
FIGS. 6 through 8 are perspective views of these similar embodiments of the handle, the handpiece being the same but each having a different carrier block.
Figure 7:
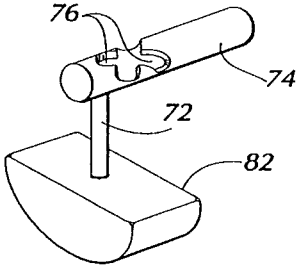
Figure 8:
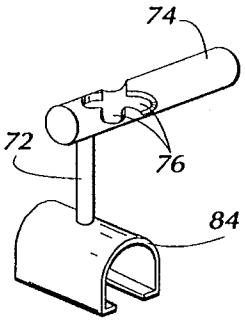
Figure 5:
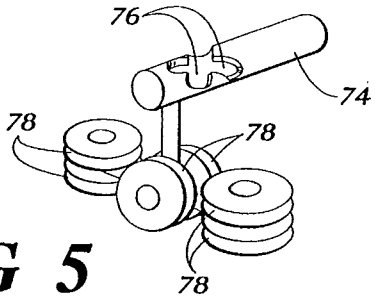
FIG. 5 is a perspective view of another embodiment of the handle.

While the same handle is shown in FIGS. 5 through 8, different block means are illustrated as alternate embodiments. In FIG. 5, a set of wheels 78 is used, the wheels being designed to ride on the inside wall surfaces of the track. In FIGS. 6 through 8, alternate block means 80, 82 and 84, respectively, are illustrated. Block means 84 is described in greater detail hereinbelow. A neck member 72 connects the handle to the block means and travels through the slot 40, as described hereinabove.

Figure 2:
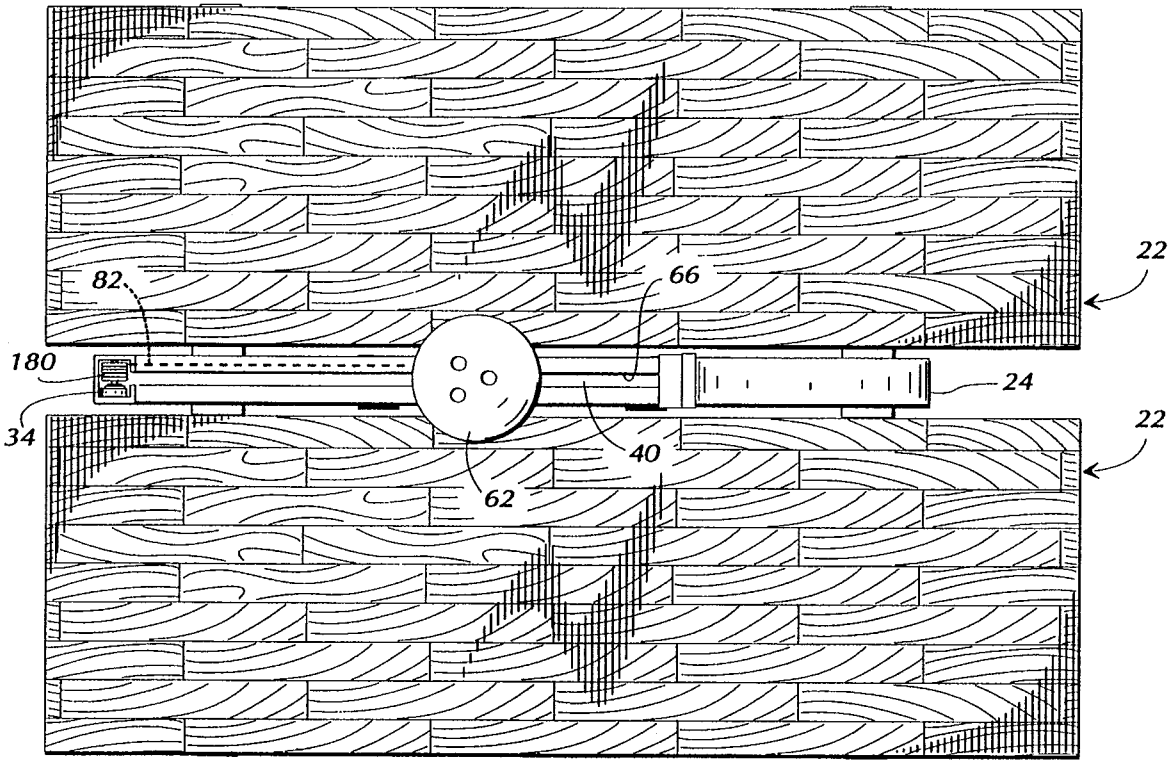
FIG. 2 is a top plan view of the present invention.

An additional embodiment of the present invention is shown in FIG. 2. In this embodiment, a tensioning device 80 is mounted at the rearmost extent of track 24. This device includes a cable 82 with the leading end (not shown) attached to the block means. The rest of the cable is wound up on a spool 84 within the tensioning device. By adjusting the tension, the user can simulate the use of a heavy or light ball, or simply use the device to exercise, the primary emphasis being on upper body conditioning.

Figure 9:
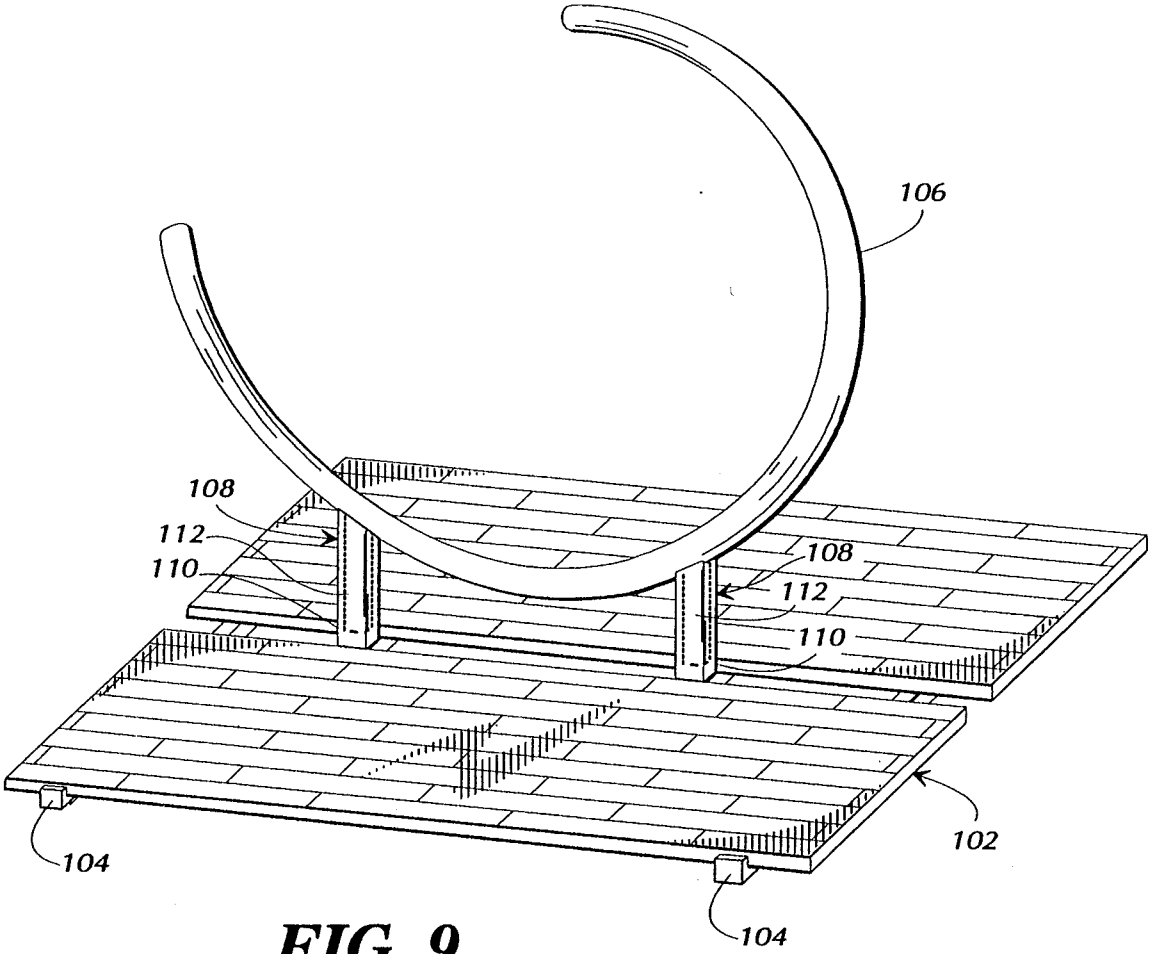
FIG. 9 is a perspective view of an alternate embodiment of the present invention.

The embodiments shown in FIGS. 9 through 12 illustrate the same concept as the previously described devices, but with a different structural arrangement. Referring to FIG. 9, this embodiment includes an elongated base 102 having feet 104 which may also serve as braces for the opposed sides of the base. The track 106 is semi-circular or arcuate, having the same basic shape as track 24, shown in FIG. 1. The track is supported with height-adjustable support means, such as the leg assemblies 108. The leg assemblies are designed with an outer leg 110 and a telescopically received inner leg 112. A locking pin or bolt (not shown) is used to secure the leg assemblies at a desired height.

Figure 10:
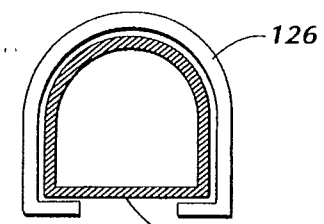
FIGS. 10 through 12 are cross sectional views of embodiments similar to that shown in the preceding figure, illustrating the engagement of the carrier block with the track.
Figure 11:
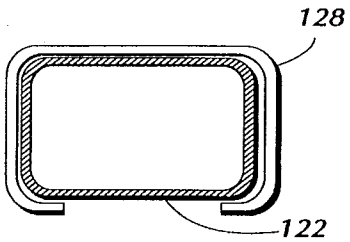
Figure 12:
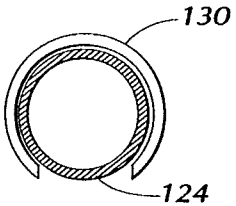

Track 106 may have a solid cross-section or it may be tubular, with several tubular forms illustrated in FIGS. 10 through 12. In FIG. 9, the track 106 is solid. FIG. 10 shows a D-shaped, hollow, tubular track 120. FIG. 11 illustrates a hollow, rectangular track 122 while FIG. 12 shows a hollow, circular track 124. In these embodiments, the carder means is disposed around the outer perimeter of the track. The carrier means 126, 128 and 130, shown in FIGS. 10 through 12 respectively, have essentially the same shape as the track, with an opening or recess being provided to accommodate the supporting leg assemblies. Any of the various handle configurations described earlier can be used with these embodiments, and the practice motion is the same. The outside surface of the tracks shown in FIGS. 9 through 12, the inside surface of the carder means, or both, may have TEFLON® or a similar substance applied thereto to facilitate sliding along the track. In addition, a tensioning device, as shown in FIG. 2, can also be utilized.

The user of the present device is thus able to practice virtually any sport which utilizes an underhand throwing motion. The device is adjustable to accommodate users of different heights and takes up relatively little space compared to actual practice at the bowling lanes, on a softball field, etc. Utilizing the present invention allows the user to "groove" his or her swing, resulting in better control, more consistency, and better scoring or performance in the particular sport or game.

Thus, while an embodiment of a practice device for sports or games utilizing an underhand throwing motion and modifications thereof have been shown and described in detail herein, various additional changes and modifications may be made without departing from the scope of the present invention.

I claim:

1. A practice device for us in practicing an underhand, swinging arm motion, comprising a base having at least one elongated portion on which a user of the device stands, an arcuate track means mounted substantially parallel to said elongated portion, and a carrier means adapted to engage and follow said track means when propelled by a user of the device for practicing the underhand arm motion, said carrier means having a handle thereon adapted to be engaged by the hand of a user, said handle including an x-shaped cutout formed therein for receiving a thumb of a user and said handle also being positioned relative to said carrier means to orient a user's hand in proper position during the underhand swinging arm motion.

2. A practice device as defined in claim 1 in which said device includes adjustable support means for mounting said track means on said base, said support means being height-adjustable.

3. A device for practicing an underhand, arm swinging motion comprising an arcuate track means having support means for maintaining said track means in a standing position and a carrier means adapted to follow said track means when moved by a user of said device for causing the user to develop a consistent underhand arm swinging motion, said carrier means including a handle means for moving said carrier means, said handle means having an X-shaped cutout means formed therein for receiving and positioning a thumb of a user and disposing the hand of a user at an angle relative to said track means for orienting a user's hand in an optimum position for accomplishing a proper swinging motion.

* * * * *